US005792003A

United States Patent [19]

Gavranovich

[11] Patent Number: 5,792,003

[45] Date of Patent: Aug. 11, 1998

[54] GOLF PUTTER

[75] Inventor: Peter Z. Gavranovich, Prospect Heights, Ill.

[73] Assignee: Crescent Golf, Inc., Prospect Heights, Ill.

[21] Appl. No.: 699,505

[22] Filed: Aug. 19, 1996

[51] Int. Cl.[6] ..... A63B 53/04

[52] U.S. Cl. ..... 473/330; 473/340; 473/314

[58] Field of Search ..... 473/292, 330, 473/313, 314, 340, 341, 349

[56] References Cited

U.S. PATENT DOCUMENTS

| | | | |
|---|---|---|---|
| 4,265,452 | 5/1981 | Vella | 473/313 |
| 4,966,369 | 10/1990 | Griffin | 473/340 |
| 5,292,128 | 3/1994 | Solheim | 473/313 |
| 5,382,019 | 1/1995 | Sneed | 473/314 |
| 5,460,375 | 10/1995 | Hardee | 473/330 |

*Primary Examiner*—William M. Pierce
*Attorney, Agent, or Firm*—Charles F. Lind

[57] ABSTRACT

The disclosed golf putter has a shaft and supported head with a bottom face or sole and a ball striking face angled relative thereto, similar to most any conventional putter, but the ball striking face is curved convex somewhat as a segment of a cylinder, instead of just being flat. The convex striking face curvature is about an axis substantially perpendicular to the bottom face, and defines a precise and limited generally centered sweet spot lying along a narrow vertical region where face-ball contact could be made; and immediately adjacent such region, the putter face is curved convexly away from the sweet spot. The convex putter face serves to compensate for many minor putting stroke errors, generally involving minor misalignments of the putting stroke line or squared up striking face with such line, where actual face-ball contact might not be on the exact sweet spot region but on the curved face adjacent thereto.

2 Claims, 1 Drawing Sheet

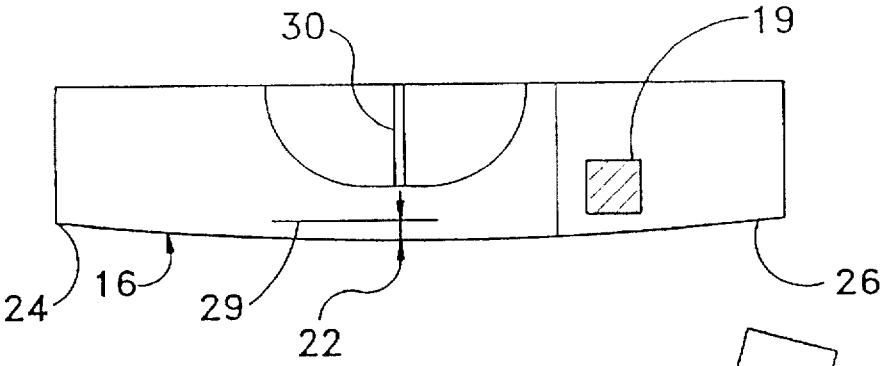
FIG.2
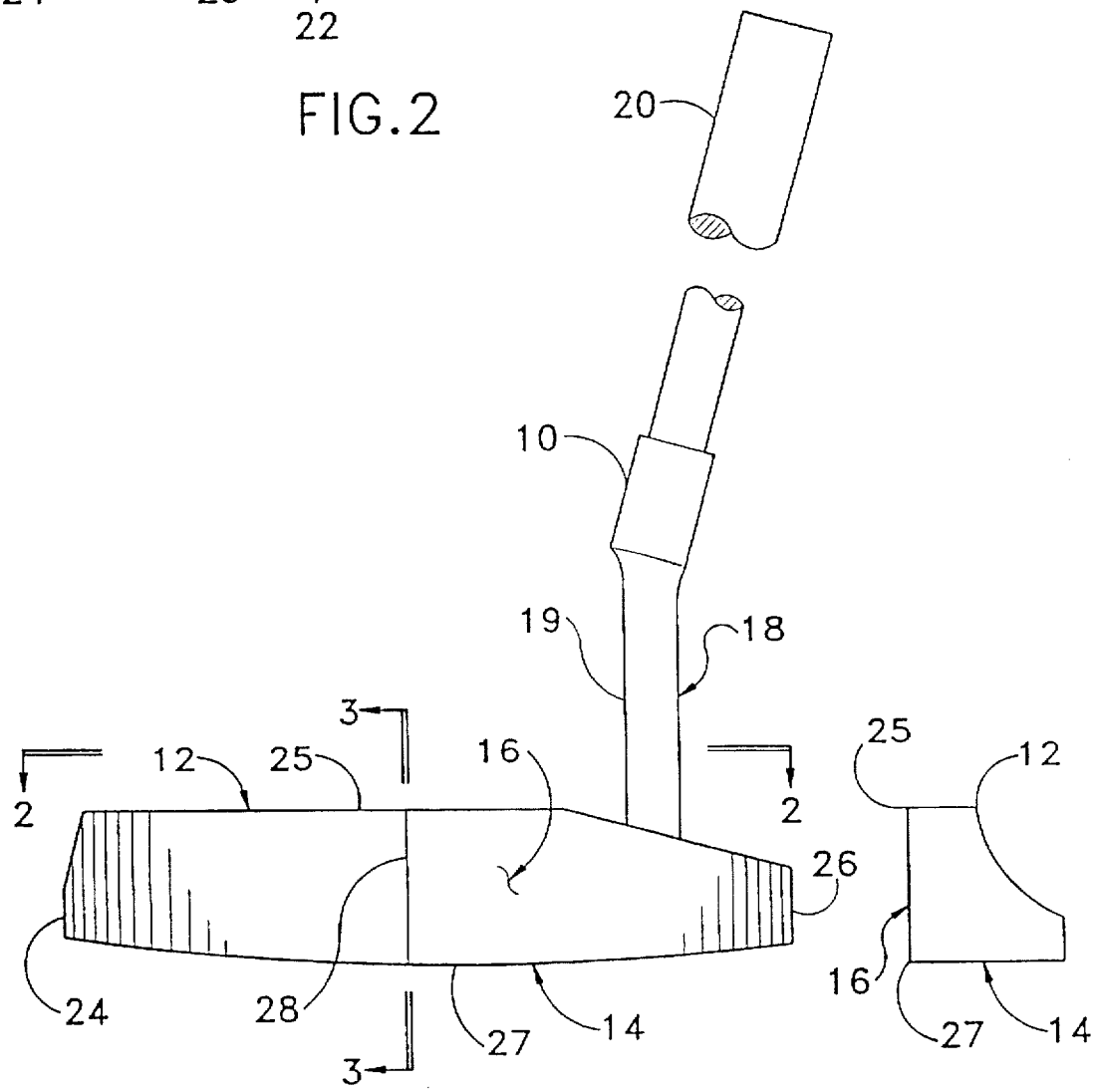
FIG.1
FIG.3

GOLF PUTTER

BACKGROUND OF THE INVENTION

Golf putters are made in many different styles, but typically each has a head and an elongated shaft projecting upwardly and laterally away from the head to an upper hand gripping area. The basic concept of a "putty" is for a golfer to manipulate the putter in a precise manner to direct a striking face on the head against a golf ball and cause it to roll across a green and fall into a spaced target hole. The striking face on each known conventional putter head is flat.

The ball travel for a typical putt is usually much less than the ball travel desired for most other golf shots, being measured in feet compared to yards, and requires a totally different golf stroke and/or touch.

For example, golf shots with most other clubs use a full swing, with extensive body and shoulder movement and/or rotation in order to move the club head over a long arc and at high speeds, for achieving accurate and/or increased flight distance of the struck ball. In other words, large muscle groups are used in directing club movement, and although the effort exerted by such muscle groups must be controlled, such effort commonly is close to the maximum. By contrast, most good golfers believe that a putting stroke should be quite compact, involving putter head travel rarely exceeding several feet, generated mostly with arm movement and little body movement or rotation otherwise, and muscle restrain requiring accuracy and control, and not effort.

Basically, every successful putt requires the golfer to accurately determine the likely roll path of the ball between its existing location and target hole, including its initial line of rolling, and the speed the ball should have when hit. Proper execution of the putt will then require the golfer to square up the putter striking face next to the ball in accordance with the initial intended line of ball travel, and then move the club head in a back stroke rearwardly away from both the ball and target hole and then in a forward stroke toward the ball with the striking face hitting the ball at a target spot on the ball surface centered on the intended line of ball movement, and directing it along the intended initial line and with the needed speed.

In an effort to reduce alignment problems, many putter heads have visible marks closely adjacent or directed toward an intended "sweet spot" on the striking face where ball-face contact should be made, and many such marks also are elongated and directionally aligned to striking face at the sweet spot and to correspond with a proper putter head movement.

Common putting stances provide that the golfer will address the ball while standing on one side of the intended initial line of ball movement, and will grip and actually move the putter shaft along a path laterally offset from both the putter head and initial line of ball movement. From an execution standpoint, unsuccessful putting strokes frequently occur due to misalignment at face-ball contact, of the putter head moving along a different non-parallel line compared to the intended initial line of ball movement, and/or of the putter face being misaligned and angled out of the perpendicular to the intended line of initial ball movement.

The offset putting stance can add to the difficulty of establishing and maintaining proper alignments, as the golfer's body quite naturally could rotate somewhat about its longitudinal generally vertical center axis during a putting stroke, causing the putter head to move along a curved path that hopefully would at putter/ball contact, have its tangent line the same as the line of intended ball travel, but otherwise causing the putter head to rotate somewhat about a generally vertical axis. Even with extensive training and effort, minor body and shoulder turning or rotation could occur, resulting in the putted ball being "pushed" or "pulled."

SUMMARY OF THE INVENTION

This invention relates to and an object of this invention is to provide an improved golf putter, and more specifically, to provide a putter having an improved striking face.

A golf putter of this invention will have a striking face that is not flat, but is convex, the convex face having a substantially centered intended sweet spot where ball-face contact should be made and adjacent face portions curving away from the sweet spot.

A preferred putter of this invention will have a convex striking face that is curving about an axis generally normal to the bottom face or sole of the putter head, presenting a substantially centered narrow sweet spot between adjacent face portions perpendicular to the line of putter head movement during a correct putting strike and curving rearwardly away therefrom toward both lateral ends of the face.

BRIEF DESCRIPTION OF THE DRAWINGS

These and other objects, features or advantages of the invention will be more fully understood and appreciated after includes as a part thereof the accompanying drawings, wherein:

FIG. 1 is an elevational view of a putter head and support handle, looking in the direction toward the striking face on the head; and FIGS. 2 and 3 are sectional views as seen generally from lines 2—2 and 3—3 respectively in FIG. 1.

DETAILED DESCRIPTION OF THE INVENTION

A golf putter 10 incorporating the invention is illustrated in the drawings, comprised mostly of conventional putter components and constructions. Thus, the putter 10 will have a head 12 with a bottom face or sole 14 and a forward striking face 16 disposed generally normal to the sole, and an elongated shaft 18 projected from its lower end via a hosel 19 away from the head to a hand gripping area 20 for a golfer near its upper end.

The striking face 16 will extend laterally between its lateral outboard and inboard ends 24 and 26 respectively and its vertically upper and lower edges 25 and 27 respectively.

In a conventional golf putter, the striking face 16 has been flat, defining a generally centered broad sweet spot where face-ball contact ideally will be made as ball impact at this location will not torque or rotate the putter relative to the golfer's gripping hands.

In the inventive putter 10 illustrated, the putter head striking face 16 is curved in a convex manner from a generally centered sweet spot 22 to both ends 24 and 26 of the face. A preferred convex face curvature would be substantially as a segment of a cylinder having a radius of possibly 14"–16". As such, a convex striking face 16 having an end-to-end width of approximately four inches will have its sweet spot 22 forwardly off-set by approximately 3/16 inch from a straight line 29 (corresponding to a flat conventional striking face) extended between the face ends 24 and 26.

With this convex putter face 16, the sweet spot 22 will actually lie along a narrow region on and closely adjacent line 28 that will be substantially perpendicular to both the bottom face or sole 14 (and the ground during a putting stroke at face-ball contact) and to the intended direction of putter head travel in moving toward the golf ball and making putting contact therewith.

A visible straight line 30 can be provided on the head 12 directed normally toward and through the sweet spot line 28 on the striking face 16, which both locates the sweet spot region 22 and provides directional assistance for establishing proper initial putter head striking face-ball alignment and putter head movement corresponding to the intended line of initial ball movement.

In the putter illustrated, the putter shaft 18 is angled vertically upward and laterally away from the head 12, so that its upper gripping area 20 is laterally offset from the sweet spot region 22 on the putter head, about thigh-high to the golfer, and along or just slightly offset from an imaginary plane extended tangent to the striking face 16 at the sweet spot 22. For reference purposes only, a typical good golfer when putting might have a putter head sweet spot-gripping area offset of 7"–14", might address the ball by standing 12"–25" laterally away from the ball movement, and might lean over to have the shoulder 7"–25" laterally away from the ball. Generally one's feet would be centered relative to the ball or just slightly forwardly or rearwardly thereof (referenced to the direction of intended ball movement).

Except for the improved design of the striking face 16, the putter 10 can be of any conventional putter design or construction. As such, the remainder of the club head 12 can be of any shape or construction; as likewise can be the shape, length, or manner or location of connection of the hosel 19 or shaft 1 to the head.

OPERATION OF THE PUTTER

It is to be noted that during a proper putting stroke, when the convex striking face at the sweet spot 22 is properly squared up perpendicular to and hits the ball surface at the intended spot on the center axis extended in line with the intended target initial ball movement, while being advanced in line with the intended initial ball movement, the putter will direct the struck ball along the intended initial ball movement line, substantially the same as a conventional flat face putter would with the same proper stroke.

However, the disclosed putter can tend to compensate for and within limits even overcome many minor misalignment hits of the putter face 16 and ball, somewhat as follows.

Consider first the errant putting stroke that would, with a flat face putter, normally have pulled the ball to roll along a line to the left of the intended line of ball travel. In this situation, most likely misalignment problem would have been that at putter-ball impact, either the club head was moving along, or the club face was angled perpendicular to, the line of actual ball movement (or both). However, with the inventive putter, the club sweet spot 20 on the convex striking face 16 would not hit the ball, but instead would pass the ball between the intended ball surface target spot and the golfer; and the part of convex striking face laterally offset of the sweet spot 28 in the direction away from the golfer will actually make contact with the ball, and this contact point on the ball would be the same as or closer to the intended ball surface target spot, and this contact point on the striking face would be angled, or at least closer to being angled, perpendicular to the intended line of ball travel. The actual line of ball travel along, or much closer to, the initially intended line of travel will likely be.

A related result will follow when considering an errant putting stroke that would, with a flat face putter, normally push the ball along a line of roll that is to the right of the intended line of ball travel, except then a likely misalignment problem would have been that at putter-ball impact, the club head had been moved along or the club face had been angled perpendicular to that misaligned line. However, with the inventive putter, the club sweet spot 22 on the convex striking face 16 will likely pass the intended ball surface target spot remotely from the golfer, and the convex striking face curving away from the sweet spot 22 and closer to the golfer will actually make contact with the ball and at a location on the ball the same as or closer to the intended ball surface target spot, and the tangent of the striking face will be angled or at least closer to being angled perpendicular to the intended line of ball travel. The actual ball travel will thus likely be along or at least much closer to being on the initially intended line of ball travel.

The convex striking face 16 curving on a radius of 14"–16" is correlated to being the approximate swing arc of the putter head, again being related to a believed major cause of unsuccessful putting strokes, or the golfer twisting or turning into the putt which will likely occur about an arc radius around the vertical center of the golfer's weight, which can be approximated by the lateral stance offset between the golfer's feet and the intended line of travel.

Another advantage of using the improved putter could be a heightened degree of concentration needed when putting, limited to the execution of having the discussed alignments accurate and true.

While the short grip putter has been illustrated and an offset putting stance specific discussed, the invention advantageously might be applied to all known putter constructions and stances.

While a specific embodiment has been illustrated, it will be obvious that minor changes could be made therefrom without departing from the spirit of the invention. Accordingly, the invention is to be determined by the scope of the following claims.

What is claimed is:

1. A golf putter comprising a head and elongated shaft, the head having a bottom face and a striking face angled therefrom, the striking face having a sweet spot region disposed between inboard and outboard ends thereof, the striking face curving from the sweet spot region in a convex manner tangentially and laterally thereof and toward both the inboard and outboard ends, the striking face curving substantially as a segment of a cylinder having its longitudinal center axis transverse to the bottom face and said sweet spot region thereby lying narrowly along a straight line disposed substantially transverse to the bottom face, the convex striking face having a radius of curvature of the order of 14"–16" and corresponding thereby approximately to the stance off-set of the golfer and intended line of ball travel when Putting and providing that the sweet spot region will be forwardly off-set by approximately 3/16 inch from a straight chord line extended between the inboard and outboard face ends spaced apart by approximately 4", and the elongated shaft projected upwardly from the head rearwardly of the striking face and laterally off-set from the sweet spot and between the sweet spot and the inboard face end.

2. A golf putter according to claim 1, further comprising a visible straight line on the head directed normally toward the striking face to line up with the sweet spot straight line region thereon.

* * * * *